US006020103A

United States Patent [19]

Tsubuko et al.

[11] Patent Number: 6,020,103

[45] Date of Patent: Feb. 1, 2000

[54] LIQUID DEVELOPER, METHOD OF PRODUCING THE LIQUID DEVELOPER AND IMAGE FORMATION USING THE SAME

[75] Inventors: Kazuo Tsubuko, Numazu; Akihiko Gotoh, Susono; Tsuyoshi Asami, Yokohama; Yukio Tabata, Mishima, all of Japan

[73] Assignee: Ricoh Company, Ltd., Tokyo, Japan

[21] Appl. No.: 08/888,110

[22] Filed: Jul. 3, 1997

[30] Foreign Application Priority Data

| | | | |
|---|---|---|---|
| Jul. 3, 1996 | [JP] | Japan | 8-192812 |
| Aug. 21, 1996 | [JP] | Japan | 8-238459 |
| Jun. 30, 1997 | [JP] | Japan | 9-189012 |

[51] Int. Cl.[7] ..... G03G 9/13

[52] U.S. Cl. ..... 430/117; 430/114; 430/115; 430/126; 430/137

[58] Field of Search ..... 430/115, 114, 430/112, 117, 126, 137

[56] References Cited

U.S. PATENT DOCUMENTS

| | | | |
|---|---|---|---|
| 4,032,463 | 6/1977 | Kawanishi et al. | 430/114 |
| 4,250,241 | 2/1981 | Tsubuko et al. . | |
| 4,264,699 | 4/1981 | Tsubuko et al. . | |
| 4,388,395 | 6/1983 | Tsubuko et al. . | |
| 4,595,646 | 6/1986 | Tsubuko et al. . | |
| 4,634,651 | 1/1987 | Okawara et al. . | |
| 4,690,881 | 9/1987 | Nagai et al. . | |
| 4,764,447 | 8/1988 | Tsubuko et al. . | |
| 4,797,341 | 1/1989 | Tsubuko . | |
| 4,855,207 | 8/1989 | Tsubuko et al. . | |
| 4,874,683 | 10/1989 | Shirai et al. | 430/114 |
| 4,925,763 | 5/1990 | Tsubuko et al. . | |
| 4,957,842 | 9/1990 | Fukase et al. . | |
| 5,019,477 | 5/1991 | Felder | 430/115 |
| 5,026,621 | 6/1991 | Tsubuko et al. . | |
| 5,061,587 | 10/1991 | Tsubuko et al. . | |
| 5,169,739 | 12/1992 | Umemura et al. . | |
| 5,204,207 | 4/1993 | Yamashita et al. . | |
| 5,270,445 | 12/1993 | Hou | 430/137 |
| 5,328,794 | 7/1994 | Kazuo et al. . | |
| 5,759,733 | 6/1998 | Tsubuko et al. | 430/115 |

FOREIGN PATENT DOCUMENTS

| | | | |
|---|---|---|---|
| 5-188659 | 7/1993 | Japan | 430/114 |
| 7-92741 | 4/1995 | Japan . | |
| 10-115953 | 5/1998 | Japan . | |

OTHER PUBLICATIONS

Japio Abstract An:98–115953 of JP 10–115953 (Pub May 6, 1998).

Japio Abstract An:95–092741 of JP 7–92741 (Pub Apr. 7, 1995).

Caplus Abstract An: 1998:277413 of JP 10–115953 (Pub May 6, 1998).

Grant, R. et al ed. Grant & Hackh's Chemical Dictionary, 5th Edition, McGraw–Hill Book Co., NY (1987) pp 28, 176, 594 and 639.

Patent & Trademark Office English–Language Translation of JP 7–92741 (Pub Apr. 1995).

Patent & Trademark Office English–Language Translation of JP 10–115953 (Pub May 1998).

Patent & Trademark Office English–Language Translation of JP 5–188659 (Pub Jul. 1993).

*Primary Examiner*—Janis L. Dote

*Attorney, Agent, or Firm*—Oblon, Spivak, McClelland, Maier & Neustadt, P.C.

[57] ABSTRACT

A liquid toner for use in a liquid developer contains a dispersion medium and toner particles, each of which toner particles contains a coloring agent and a binder agent and is dispersed in the dispersion medium, the toner particles comprising small toner particles with a particle diameter of 0.1 $\mu$m or less in an amount of 20 wt. % or less of the total weight of the toner particles, and having an average particle diameter of 0.3 to 5 $\mu$m. Using the above-mentioned liquid toner in which the amount of the toner particles is controlled to 5 to 100 wt. % of the total weight of the liquid toner, a latent electrostatic image formed on a photoconductor can be developed to a toner image.

17 Claims, No Drawings

LIQUID DEVELOPER, METHOD OF PRODUCING THE LIQUID DEVELOPER AND IMAGE FORMATION USING THE SAME

BACKGROUND OF THE INVENTION

1. Field of the Invention

The present invention relates to a liquid developer for use in electrophotographic copying apparatus, conventional printers, facsimile apparatus, and ink-jet printers.

The present invention also relates to a method of producing the above-mentioned liquid developer and an image formation method using the same.

2. Discussion of Background

Developers for use in electrophotography are roughly classified into two groups, that is, a dry developer and a wet developer (or liquid developer). The liquid developer is capable of producing clearer images than the dry developer due to the use of toner particles with a smaller particle size therein. Because of this advantage, the merits of the liquid developer have been discovered in recent years.

In general, a liquid developer for use in electrophotography is prepared by dispersing a toner comprising a coloring agent and a binder agent as the main components, optionally with the addition of a charge controlling agent thereto, in a carrier liquid.

The coloring agent comprises, for example, carbon black, an organic pigment or dye stuff. Examples of binder agents are natural or synthetic resins such as acrylic resin, phenol-modified alkyd resin, rosin and synthetic rubber. Examples of charge controlling agents are lecithin, metallic soap, linseed oil and higher fatty acids. The carrier liquid comprises as the main component a highly-insulating solvent with a low dielectric constant, such as a petroleum-based aliphatic hydrocarbon solvent.

In an electrophotographic process using such a liquid developer, latent electrostatic images are formed on a photoconductor and developed with a liquid developer prepared by diluting a concentrated liquid toner with a solid content of 5 to 90 wt. % with a carrier liquid having high insulating properties. More specifically, for example, in an electrophotographic copying machine, a bottle for the concentrated liquid developer and a bottle for the carrier liquid are disposed. As the concentrated liquid toner and the carrier liquid are consumed in the course of making copies, the concentrated liquid toner and the carrier liquid are replenished in accordance with the detection of the consumption of the respective components.

After development of latent electrostatic images formed on the photoconductor with the liquid developer, an excess of the liquid developer is removed from the surface of the photoconductor by a corona discharger or a squeeze roller which is rotated in the opposite direction to the rotating direction of the photoconductor, but out of contact with the photoconductor. The toner images remaining on the photoconductor are then transferred to a transfer sheet, and fixed thereto.

In the case where the excess of the liquid developer is removed from the photoconductor, using the squeeze roller, when the viscosity of the liquid developer is excessively high, the developer cannot be sufficiently removed from the surface of the photoconductor by the squeeze roller, and too much an amount of the liquid developer to develop clear images stays on the photoconductor, while when the viscosity of the liquid developer is excessively low, the developer is excessively removed from the surface of the photoconductor by the squeeze roller, and too small an amount of the liquid developer to develop clear images is left on the photoconductor. The result is that in either case, images with uniform and sufficient density cannot be obtained, in particular, in solid image areas.

The toner images formed on the photoconductor are transferred to a transfer sheet such as plain paper. The transfer ratio of the toner particles in the liquid toner from the photoconductor to the transfer sheet varies depending on the properties of the transfer sheet, such as surface smoothness, oil absorption and thickness, but is generally in the range of 50 to 100%. The toner transfer ratio is defined by the ratio of the weight of the toner particles transferred to the transfer sheet to that of the toner particles deposited on the photoconductor before toner image transfer.

When paper with low surface smoothness such as a bond paper is used for image transfer, the toner transfer ratio is as low as 50%. In such a case, it is necessary to remove the remaining liquid toner from the surface of the photoconductor, using cleaning means such as a cleaning blade after image transfer. If the liquid toner remains on the photoconductor even after the cleaning operation, and is repeatedly subjected to the charging, exposure and development in the course of the electrophotographic process, the liquid toner is formed into a toner film on the photoconductor, which is referred to as "toner filming phenomenon", and the thus formed toner film causes the formation of abnormal images, such as smeared toner images transferred to a transfer sheet.

The above-mentioned toner filming phenomenon has attracted special attention in recent years as being a very serious problem when color toners, in particular cyan-color toners, are used. Many trials have not yet been made for solving this filming problem for color toners, and the problem has not yet been solved.

In Japanese Laid-Open Patent Application 60-179750, there is proposed a toner comprising an acid amide compound in light of the toner filming problem. When the toner was subjected to a continuous copying operation by a conventional development method, the occurrence of the filming phenomenon was observed after making about 600 to 1,500 copies. Thus, high quality image cannot be produced for an extended period of time by a conventional development method.

In Japanese Laid-Open Patent Application 49-071943, there is proposed a developer comprising as a charge controlling agent a higher alkylamine compound or a quaternary ammonium salt compound in order to improve the tone reproduction of images. However, the tone reproduction becomes poor when a concentrated toner for use in the liquid developer is stored for a long period of time.

In Japanese Laid-Open Patent Applications 51-024244 and 58-052652, there are disclosed liquid toners. These liquid toners comprise a higher alcohol and show the same tendency as mentioned above, that is, the tendency of the tone reproduction becoming poor when a concentrated toner for use in the liquid developer is stored for a long period of time.

Furthermore, in the course of the development which is carried out, using the liquid toner or developer, the toner composition is not necessarily uniformly attracted to the latent electrostatic images by electrophoresis. Finely-divided components of the toner, such as finely-divided components of a resin, a dispersant and a pigment are gradually dissolved into the carrier liquid in the course of the repeatedly carried out development, and such finely-divided components are built up in the carrier liquid. As a result, the viscosity of the liquid developer is gradually excessively increased in the course of the repeatedly carried out development, and as mentioned previously, when the viscosity of the liquid developer becomes excessively high, the developer cannot be sufficiently removed from the surface of the photoconductor by the squeeze roller, and too much an amount of the liquid developer to develop clear images remains on the photoconductor, causing the formation of abnormal toner images.

SUMMARY OF THE INVENTION

Accordingly, a first object of the present invention is to provide a liquid developer for in electrophotography, which does not cause the toner filming phenomenon and is capable of producing clear images with excellent resolution and gradation for an extended period of time.

A second object of the present invention is to provide a method of producing the above-mentioned liquid developer.

A third object of the present invention is to provide an image formation method capable of producing high quality images with excellent resolution and gradation for an extended period of time without causing the filming phenomenon.

The first object of the present invention can be achieved by a liquid developer comprising (i) a liquid toner comprising a dispersion medium and toner particles, each of which toner particles comprises a coloring agent and a binder agent and is dispersed in the dispersion medium, the toner particles comprising small toner particles with a particle diameter of 0.1 μm or less in an amount of 20 wt. % or less of the total weight of the toner particles, and having an average particle diameter of 0.3 to 5 μm, and (ii) a carrier liquid in which the liquid toner is dispersed.

The second object of the present invention can be achieved by a method of producing a liquid developer comprising the steps of kneading or flushing a coloring agent and a binder agent to prepare a kneaded or flushed mixture of the coloring agent and the binder agent, pulverizing the kneaded or flushed mixture to prepare toner particles which comprise small toner particles with a particle diameter of 0.1 μm or less in an amount of 20 wt. % or less of the total weight of the toner particles, and have an average particle diameter of 0.3 to 5 μm, dispersing the toner particles in a dispersion medium to prepare a liquid toner, and diluting the liquid toner with a carrier liquid.

The third object of the present invention can be achieved by an image formation method comprising the step of developing a latent electrostatic image formed on a photoconductor to a toner image, using a liquid toner comprising (a) toner particles, each of which toner particles comprises a coloring agent and a binder agent, the toner particles comprising small toner particles with a particle diameter of 0.1 μm or less in an amount of 20 wt. % or less of the total weight of the toner particles, and having an average particle diameter of 0.3 to 5 μm, and (b) a dispersion medium in which the toner particles are dispersed, the amount of the toner particles being in the range of 5 to 100 wt. % of the total weight of the liquid toner. Such image formation method can further comprise the steps of:

transferring the toner image to an intermediate image-transfer medium, and transferring the toner image from said intermediate image-transfer medium to a transfer sheet.

DESCRIPTION OF THE PREFERRED EMBODIMENTS

In order to solve the previously mentioned conventional problem of the liquid developer and stably obtain high quality images, the inventors of the present invention have intensively made researches on the mechanism of the toner filming phenomenon caused by the liquid developer.

As previously mentioned, it has been found that when the development is repeatedly carried out, the finely-divided components constituting the toner, such as a resin, a dispersant and a pigment are gradually dissolved into the dispersion medium, thereby increasing the viscosity of the liquid developer.

As a matter of course, with the excessive increase of viscosity of the liquid developer, the liquid developer deposited on the photoconductor cannot be sufficiently removed therefrom after passing through the squeeze roller.

However, when the viscosity of the liquid developer is extremely decreased, the amount of liquid developer remaining on the photoconductor is too small after the squeezing operation. As a result, the image transfer performance becomes poor, and the toner filming phenomenon will easily occur. In addition, the thus obtained image is free from uniform image density, and a solid image is also lacking in uniformity.

Thus, the inventors of the present invention have discovered that when the ratio of the toner particles with a small particle diameter contained in the liquid developer is limited, the solid content in the liquid developer can be prevented from increasing so as to maintain the viscosity thereof even though the development operation is repeatedly carried out.

A liquid developer according to the present invention is prepared by diluting a liquid toner with a carrier liquid. The liquid toner of the present invention, which can be used for the electrophotographic process as it is, comprises (a) a dispersion medium and (b) toner particles, each of which toner particles comprises a coloring agent and a binder agent and is dispersed in the dispersion medium, the toner particles comprising small toner particles with a particle diameter of 0.1 μm or less in an amount of 20 wt. % or less, preferably in an amount of 15 wt. % or less of the total weight of the toner particles, and having an average particle diameter of 0.3 to 5 μm, preferably 0.2 to 1.0 μm. Therefore, the filming phenomenon can be effectively prevented.

It has been confirmed that the toner particles with a particle diameter of 0.1 μm or less (hereinafter referred to as small toner particles) are inferior in terms of the transfer performance. The transfer ratio of toner particles with a particle diameter of 0.5 μm or more is as high as about 80%, while that of the small toner particles with a particle diameter of 0.1 μm or less is decreased to about 30% or less.

The reason for this is that the small toner particles with a particle diameter of 0.1 μm or less form a toner image layer with high density on the photoconductor. The amount of dispersion medium held in such a toner image layer is insufficient, so that the rate of electrophoresis of small toner particles is decreased, and consequently, the transfer ratio is decreased.

In the liquid developer of the present invention, the average particle diameter of the toner particles is in the range of 0.3 to 5 μm, preferably in the range of 0.3 to 1.0 μm. When the average particle diameter of the toner particles is within the above-mentioned range, the decrease of the toner transfer ratio can be prevented, so that the image density, sharpness and the resolution of the obtained image can be prevented from deteriorating. In addition, when the average particle diameter of toner particles is not within the above-mentioned range, the toner particles remaining on the photoconductor cannot be removed therefrom even by using cleaning means such as a blade or a foam roller.

The particle diameter of toner particle is measured by the method of centrifugal sedimentation using a particle size distribution measuring instrument.

Furthermore, to prevent the toner filming phenomenon, it is preferable that the toner particles have a melt viscosity of 100 to 12,000 mPa·s, more preferably in the range of 1,000 to 6,000 mPa·s at 120° C.

It is considered that the viscoelasticity of the toner at the above-mentioned temperature has a serious effect on the cleaning properties of the toner.

The melt viscosity of toner at 120° C. is measured by use of a commercially available apparatus "RHEOMETRICS" (Trademark), made by Rheometrics Incorporated in U.S.A.

In the liquid developer of the present invention, toner particles comprise a coloring agent and a binder agent, with a charge controlling agent being optionally added thereto. Those toner particles are dispersed in a nonpolar dispersion medium with high insulating properties.

Any nonpolar liquid with high insulating properties may be used as the dispersion medium. Preferable examples of the dispersion medium for use in the present invention include a hexane-, octane-, isooctane-, decane- and isoparaffin-based solvents, for example, commercially available products "ISOPAR E™", "ISOPAR G™", "ISOPAR H™", "ISOPAR L™", "ISOPAR M™" and "ISOPAR V™" (which are trademarks of Exxon Chemical Japan Ltd.), a commercially available product "SHELLSOL 71™" (which is a trademark of Yuka Shell Epoxy K.K.), isoparaffin, and n-paraffin; silicone oils; fatty acid esters; fluorine-containing oils; and waxes. Those may be used alone or in combination.

The coloring agent for use in the toner particles makes the latent electrostatic image visible. There can be employed a variety of inorganic and organic pigments and dyes. For example, carbon black, ultramarine, Prussian blue, phthalocyanine pigments, azine pigments, triphenylmethane pigments, azo pigments and dyes, and condensation pigments and dyes are usable.

In particular, for the purpose of effectively preventing the toner filming phenomenon, it is preferable that the coloring agent comprise a pigment which is coated with such a resin that is insoluble in the dispersion medium to be employed. Namely, the pigment is scarcely dissolved into the dispersion medium in the course of the dispersion step by coating the surface of the pigment with the above-mentioned resin.

For instance, a resin-coated pigment may be prepared by the following flushing method:

A mixture of the following components is kneaded in a kneader at 140° C.:

| | Parts by Weight |
|---|---|
| Phthalocyanine blue | 30 |
| Styrene-vinyltoluene-vinyl pyrrolidone copolymer (40/3/5) | 80 |

The thus kneaded mixture is further kneaded and ground using a heated roller of 150° C. for 2 hours, so that a resin-coated-pigment is prepared.

As such a resin used for coating the pigment, polymers which are insoluble in the previously mentioned dispersion medium, for example, styrene-vinyltoluene-vinyl pyrrolidone copolymer, acrylic resin, ethylene-acrylic acid copolymer and ethylene-methyl methacrylate-fumaric acid copolymer can be employed.

By such resin-coating treatment, generation of small toner particles with a particle diameter of 0.1 μm or less can be effectively prevented while the toner particles are dispersed in the dispersion medium.

Furthermore, in general, the commercially available pigments contains a dispersant such as a rosin, rosin-modified resin, wax or surfactant therein. Therefore, the pigment is dissolved into the dispersion medium in the preparation of the liquid toner. Further, the dispersant contained in the pigment is dissolved into the dispersion medium during the development of latent electrostatic images, which induces the filming phenomenon. In light of the action of the dispersant, it is preferable that the pigment not comprising a dispersant be employed for the coloring agent. Such a dispersant-free pigment is hardly dissolved into the dispersion medium, so that the filming phenomenon can be prevented.

As the binder agent for use in the toner particles, various resins and polymers with fixing properties can be employed.

Examples of the binder agent for use in the present invention are vinyl ester polymers such as vinyl acetate and vinyl propionate; acrylic and methacrylic ester polymers; synthetic resin rubbers such as styrene-butadiene rubber; natural rubbers and modified products thereof; rosin and rosin-modified resins; epoxy resin; silicone resin; styrene resin; coumarone-indene resin; petroleum resins such as cyclopentadiene polymer; ethylene-vinyl acetate copolymer; ethylene-acrylic acid copolymer; ethylene-methyl acrylate-acrylic acid copolymer; and polyethylene wax.

The charge controlling agent for use in the toner particles serves to stably maintain the polarity of the obtained toner image. For example, there can be employed inorganic and organic pigments; organic dyes; resins comprising a polar group in the molecule thereof; and aromatic carboxylic acid, alcohol, ketone, ester, ether and amine, and polymers comprising the above-mentioned components. When necessary, a variety of metallic soaps such as cobalt naphthenate and manganese octenoate can also be employed.

The above-mentioned components constituting the toner particles are not definitely classified in terms of the functions. For example, the pigment or dye may serve as both the coloring agent and the charge controlling agent. In addition, the resin or polymer comprising a polar group in the molecule thereof works as not only the binder agent, but also the charge controlling agent.

Further, in order to prevent the filming phenomenon and improve the resolution and gradation of the obtained images, it is preferable that the toner particles for use in the liquid toner further comprise finely-divided particles with a specific gravity of 2.5 g/cm$^3$ or more, more preferably in the range of 3.0 to 6.0 g/cm$^3$. In this case, if the specific gravity of the employed finely-divided particles is less than 2.5 g/cm$^3$, the effect of improving the resolution and gradation of image cannot be expected.

For the above-mentioned finely-divided particles with a specific gravity of 2.5 g/cm$^3$ or more, metals, metallic oxides, metallic acid salts, metallic nitrides, and metallic carbonates are usable.

Specific examples of the metal for the above-mentioned finely-divided particles include iron, manganese, nickel, cobalt, zinc, aluminum, and alloys of at least two metals selected from the group consisting of iron, manganese, nickel, cobalt, zinc and aluminum.

Specific examples of the metallic oxide for the finely-divided particles are iron oxide, manganese oxide, nickel oxide, cobalt oxide, zinc oxide, aluminum oxide, cerium oxide, titanium oxide, zirconium oxide, molybdenum oxide, lanthanum oxide, tin oxide and tungsten oxide.

Specific examples of the metallic acid salt for use in the present invention include titanates such as zinc titanate, barium titanate, strontium titanate, lead titanate and aluminum titanate; and zirconates such as zinc zirconate, barium zirconate, strontium zirconate, aluminum zirconate, calcium zirconate and lead zirconate.

Specific examples of the metallic nitride for the finely-divided particles are titanium nitride and zirconium nitride.

As an example of the metallic carbonate, zirconium carbonate can be employed.

It is preferable that the above-mentioned finely-divided particles have an average particle diameter of 0.1 to 15 μm, and more preferably in the range of 0.1 to 5 μm. When the particle diameter is within the above-mentioned range, the finely-divided particles can serve to prevent the filming phenomenon effectively without impairing the sharpness and resolution of the obtained images.

It is preferable that the amount of the above-mentioned finely-divided particles be in the range of 0.1 to 20 wt. %, more preferably 1 to 10 wt. % of the total weight of the toner particles. By adding the finely-divided particles in such an amount, the filming phenomenon can be efficiently prevented without decreasing the image density.

To prepare the liquid developer of the present invention, the above-mentioned finely-divided particles may be added to the mixture of the coloring agent and the resin in the course of the step of flushing or kneading. This adding method has the advantage that the filming phenomenon can be more effectively prevented. This is because the finely-divided particles can be more uniformly contained in the toner particles when the finely-divided particles are mixed with the coloring agent and the binder agent at the kneading or flushing step as compared with the case where they are mixed with the obtained toner particles.

Furthermore, as a resin component used in the above-mentioned flushing step, there can be employed polyethylene resins, such as commercially available products "SANWAX E200™", "SANWAX E250P™" and "SANWAX 131-P™" (which are trademarks of Sanyo Chemical Industries, Ltd.); polypropylene resins, such as commercially available products "VISCOL 500P™" and "VISCOL 600P™" (which are trademarks of Sanyo Chemical Industries, Ltd.); vinyl chloride resins, such as commercially available products "DENKA VINYL SS-100™", "DENKA VINYL SS-130™" and "DENKA VINYL DSS-130™ " (which are trademarks of Denki Kagaku Kogyo K.K.); paraffin wax; natural wax; and surfactant.

To produce a liquid developer of the present invention, a coloring agent and a binder agent are kneaded or flushed to prepare a kneaded or flushed mixture of the coloring agent and the binder agent, and the thus kneaded or flushed mixture is pulverized to prepare toner particles which comprise small toner particles with a particle diameter of 0.1 μm or less in an amount of 20 wt. % or less of the total weight of the toner particles, and have an average particle diameter of 0.3 to 5 μm. Then, the toner particles are dispersed in a dispersion medium to prepare a liquid toner. In addition, the thus prepared liquid toner may be diluted with a carrier liquid.

Furthermore, when the liquid developer of the present invention is prepared, it is preferable to wash the coloring agent such as a pigment with water or a solvent for removing surface treating agents and/or additives from the coloring agent before the kneading or flushing step. By this step, the additives such as a dispersant contained in the pigment can be removed, so that it is considered that this step will contribute to the prevention of filming phenomenon.

To control the amount of small toner particles with a particle diameter of 0.1 μm or less to 20 wt. % or less in the course of the preparation of the liquid toner, the following methods are available:

(A) Separation of Small Toner Particles After Dispersion (1) Centrifugal separation The liquid toner is placed in a centrifugal separator to separate the small toner particles with a particle diameter of 0.1 μm or less. To be more specific, the liquid toner is subjected to centrifugal separation at 1,000 to 30,000 r.p.m. for 30 to 60 minutes, and then, the obtained upper layer containing small toner particles may be taken out.

(2) Filtration

The liquid toner is filtered through various filters such as a filter paper or filter fabric to separate the small toner particles.

(3) Electrodeposition

The liquid toner is subjected to electrodeposition in such a manner that a direct voltage of 1 to 10 kV is applied across the electrodes. In the case where the liquid toner is positively chargeable, the toner particles deposited on the cathode may be collected. On the other hand, since the negatively chargeable toner is attracted to the anode, the toner particles deposited on the anode may be collected.

According to the above-mentioned electrodeposition, small toner particles with a particle diameter of 0.1 μm or less are slow in electrophoresis, so that they can be separated. In addition, the solid content in the liquid toner can be controlled to 15 to 95 wt. %.

(B) Separation of Small Toner Particles Before Dispersion (1) Controlling by Synthesis In the case where a liquid toner is obtained by polymerization, the polymerization of toner may be carried out so as not to generate the small toner particles with a particle diameter of 0.1 μm or less by controlling the amount of dispersant to be added and controlling the formulation comprising a monomer and a pigment.

(2) Controlling by Purification

The resin and the pigment may be previously subjected to purification for removing the low-molecular weight polymer components and the components for use in the pigment which are soluble in a dispersion medium to be employed.

By the above-mentioned methods, the amount of the small toner particles with a particle diameter of 0.1 μm or less may be controlled to 20 wt. % or less, preferably 15 wt. % or less of the total weight of the toner particles.

When the toner concentration of the conventional liquid developer is increased, the filming phenomenon easily takes place although the image density of the obtained images can be increased. Therefore, the toner concentration is conventionally lowered to 3.0 wt. % or less, preferably 1.0 wt. % or less in the liquid developer.

In contrast to this, the liquid toner of the present invention can effectively prevent the toner filming phenomenon, so that image formation can be achieved using a liquid toner according to the present invention which comprises the toner particles in an amount of as high as 5 to 100 wt. % of the total weight of the liquid toner.

When such a liquid toner with high toner concentration is used for developing latent electrostatic images formed on a photoconductor, it is preferable to provide an overcoat layer on the photoconductor. For instance, a thin film layer serving as a water- and oil-repellent layer comprising a silicone resin or fluorine-containing resin may be provided on the selenium photoconductor.

Alternatively, before the latent electrostatic images formed on the photoconductor are developed to toner images using the liquid toner with a high toner concentration, the latent electrostatic images may be previously wetted with a liquid with high insulating properties.

Other features of this invention will become apparent in the course of the following description of exemplary embodiments, which are given for illustration of the invention and are not intended to be limiting thereof.

EXAMPLE 1

The following components were mixed and dispersed in an attritor at 30° C. for 2 hours, so that a comparative liquid toner A was prepared:

| | Parts by Weight |
|---|---|
| Carbon black "MA-100" (Trademark), made by Mitsubishi Carbon Co., Ltd. | 10 |
| Styrene - vinyl acetate copolymer | 80 |
| Lecithin | 0.5 |
| "ISOPAR H" (Trademark), made by Exxon Chemical Japan Ltd. | 300 |

From the thus prepared comparative liquid toner A, three kinds of liquid toners B, C and D according to the present invention were obtained in the following manners:

The liquid toner A was subjected to centrifugal separation at 3,000 r.p.m. for 15 minutes for removing the small toner particles, so that a liquid toner B according to the present invention as shown in Table 1 was obtained.

The liquid toner A was filtered through a filter with a pore size of 0.1 $\mu$m over a period of 24 hours to remove the small toner particles. Thus, a liquid toner C according to the present invention as shown in Table 1 was obtained.

The liquid toner A was subjected to electro-deposition for 60 seconds in such a manner that a direct voltage of +6 kV was applied across the electrodes for removing the small toner particles. Thus, a liquid toner D according to the present invention as shown in Table 1 was obtained.

As for the above obtained liquid toners A, B, C and D, the amount of small toner particles with a particle diameter of 0.1 $\mu$m or less, and the average particle diameter of toner particles for use in each liquid toner were measured using a particle size distribution measuring instrument according to the method of centrifugal sedimentation. The results are shown in Table 1.

In addition, the melt viscosity of the toner for use in each liquid toner was measured at 120° C. by use of a commercially available apparatus "RHEOMETRICS" (Trademark), made by Rheometrics Incorporated in U.S.A. The results are also shown in Table 1.

Then, each liquid toner was appropriately diluted with a proper carrier liquid and set in a commercially available electrophotographic copying machine "DT-5300" (Trademark), made by Ricoh Company, Ltd., and the following evaluation tests were carried out.

(1) Filming Phenomenon

The number of transfer sheets subjected to copying operation was counted until the filming phenomenon occurred.

(2) Image Density

The image density of the produced images was measured using a McBeth densitometer.

(3) Gradation

The gradation of the obtained images was evaluated on a scale from 1 to 10 using a gray scale.

(4) Image Blurring

The image blurring of the obtained images was visually evaluated on a scale from 1 to 5.

5: There was no blurring in the obtained images.

4: The image blurring was slightly observed.

3: The image blurring was partially observed, but acceptable for practical use.

2: The image blurring was partially observed, and it is not acceptable for practical use.

1: The image blurring was entirely observed.

(5) Resolution

The resolution of the obtained images was evaluated in accordance with the resolving power chart specified by The Society of Electrophotography of Japan.

When the resolution was 5.3 or less, the liquid toner employed was considered to be unacceptable for practical use.

The results of the above-mentioned evaluation tests are shown in Table 2.

TABLE 1

| | Comparative Toner A | Toner B | Toner C | Toner D |
|---|---|---|---|---|
| Amount of small toner particles (wt. %) | 33 | 12 | 16 | 14 |
| Average toner particle dia. ($\mu$m) | 0.28 | 0.65 | 0.53 | 0.62 |
| Melt viscosity at 120° C. (mPa · s) | 750 | 800 | 852 | 1050 |

TABLE 2

| | Comparative Toner A | Toner B | Toner C | Toner D |
|---|---|---|---|---|
| Filming Phenomonon (The number of sheets) | 500 | 1000 or more | 1000 or more | 1000 or more |
| Image density | 1.25 | 1.31 | 1.33 | 1.36 |
| Gradation | 7 | 7 | 7 | 7 |
| Image blurring | 2 | 4 | 4 | 5 |
| Resolution | 6.0 | 6.8 | 7.2 | 7.3 |

EXAMPLE 2

A mixture of the following components was dispersed in a ball mill for 24 hours:

| | Parts by Weight |
|---|---|
| Indigo red | 50 |
| Lauryl methacrylate | 120 |
| Styrene | 50 |
| Methacrylic acid | 10 |
| Benzoyl peroxide (BPO) | 5 |

-continued

| | Parts by Weight |
|---|---|
| Dispersant "POLYETHYLENE WAX 250P" (Trademark) made by Sanyo Chemical Industries, Ltd. | 5 |

The thus obtained dispersion was added dropwise to a mixture of 300 parts by weight of silicone oil and 100 parts by weight of isopropyl myristate placed in a flask over a period of 2 hours, and then polymerization was carried out at 80° C. for 6 hours. Thus, a liquid toner E according to the present invention was prepared.

EXAMPLE 3

A mixture of the following components was dispersed in a keddy mill for 2 hours:

| | Parts by Weight |
|---|---|
| Copper phthalocyanine blue (containing a dispersant) | 10 |
| Styrene - vinyltoluene - maleic anhydride copolymer | 40 |
| Styrene - butadiene resin | 20 |
| "ISOPAR M" (Trademark), made by Exxon Chemical Japan Ltd. | 100 |

Thus, a liquid toner F according to the present invention was obtained.

EXAMPLE 4

The procedure for preparation of the liquid toner F in Example 3 was repeated except that the copper phthalocyanine blue for use in the formulation for the liquid toner F in Example 3 was successively washed with alcohol and water, purified in toluene, and dried before mixing with other components in the Keddy mill.

Thus, a liquid toner G according to the present invention was obtained.

EXAMPLE 5

The procedure for preparation of the liquid toner F in Example 3 was repeated except that the copper phthalocyanine blue for use in the formulation for the liquid toner F in Example 3 was replaced by a copper phthalocyanine blue not containing a dispersant.

Thus, a liquid toner H according to the present invention was obtained.

EXAMPLE 6

The procedure for preparation of the liquid toner F in Example 3 was repeated except that the copper phthalocyanine blue for use in the formulation for the liquid toner F in Example 3 was previously kneaded under the application of heat thereto together with a vinyl acetate resin which was not soluble in "Isopar M™" to produce a vinyl-acetate-resin coated pigment before the dispersion step in the Keddy mill.

Thus, a liquid toner I according to the present invention was obtained.

As for the above obtained liquid toners E, F, G, H and I, the amount of small toner particles with a particle diameter of 0.1 μm or less, the average particle diameter of toner particles, and the melt viscosity of toner particles for use in each liquid toner were measured in the same manner as in Example 1. The results are shown in Table 3.

Then, each liquid toner was appropriately diluted with a proper carrier liquid, and set in a commercially available electrophotographic copying machine "DT-5300" (Trademark), made by Ricoh Company, Ltd., and the same evaluation tests as conducted in Example 1 were carried out. The results are shown in Table 4.

Then, using each liquid toner which was not diluted with a carrier liquid, the copying test was carried out. In this case, the above-mentioned photoconductor was modified in such a manner that a silicone resin layer was provided on the surface of the selenium photoconductor. As a result, image formation was achieved by the liquid toner with a high toner concentration, without causing the toner filming phenomenon.

TABLE 3

| | Toner E | Toner F | Toner G | Toner H | Toner I |
|---|---|---|---|---|---|
| Amount of small toner particles (wt. %) | 1 or less | 19 | 13 | 9 | 2 |
| Average toner particle dia. (μm) | 2.0 | 0.90 | 0.83 | 0.96 | 0.85 |
| Melt viscosity at 120° C. (mPa · s) | 3600 | 1260 | 1250 | 1300 | 3600 |

TABLE 4

| | Toner E | Toner F | Toner G | Toner H | Toner I |
|---|---|---|---|---|---|
| Filming Phenomenon (The number of sheets) | 3000 | 3500 | 5000 | 6200 | 10,000 or more |
| Image density | 1.39 | 1.40 | 1.43 | 1.45 | 1.50 |
| Gradation | 6 | 7 | 7 | 7 | 7 |
| Image blurring | 4 | 4 | 4 | 4 | 4 |
| Resolution | 5.6 | 6.3 | 7.6 | 7.6 | 6.3 |

EXAMPLE 7

A mixture of the following components was dispersed in an attritor at 40° C. for 3 hours:

| | Parts by Weight |
|---|---|
| Carbon black "MITSUBISHI #44" (Trademark) made by Mitsubishi Carbon Co., Ltd. | 100 |
| Styrene - butadiene copolymer resin | 80 |
| Lecithin | 3 |
| "ISOPAR H" (Trademark), made by Exxon Chemical Japan Ltd. | 500 |

100 g of the thus obtained mixture was stirred together with 10 g of zinc oxide particles with a specific gravity of 5.8 g/cm$^3$ and 5 g of zinc titanate particles with a specific gravity of 4.5 g/cm$^3$ in a homomixer, so that a liquid toner J according to the present invention was obtained.

EXAMPLE 8

The following components were kneaded in a kneader at 120° C. for 4 hours to prepare a mixture A:

| | Parts by Weight |
|---|---|
| Carbon black "MITSUBISHI #44" (Trademark) made by Mitsubishi Carbon Co., Ltd. | 200 |
| Styrene - butadiene copolymer resin | 160 |
| Zinc titanate particles (Specific gravity: 5.2 g/cm$^3$) | 68 |

Then, the following components were dispersed in an attritor at 40° C. for 3 hours:

| | Parts by Weight |
|---|---|
| Mixture A | 180 |
| Lecithin | 3 |
| "ISOPAR H" (Trademark), made by Exxon Chemical Japan Ltd. | 500 |

Thus, a liquid toner K according to the present invention was obtained.

EXAMPLE 9

The procedure for preparation of the liquid toner J in Example 7 was repeated except that the finely-divided particles of 10 g of zinc oxide and 5 g of zinc titanate employed in Example 7 were replaced by finely-divided particles of 15 g of zinc zirconate with a specific gravity of 3.7 g/cm$^3$.

Thus, a liquid toner L according to the present invention was obtained.

EXAMPLE 10

A mixture of the following components was kneaded in a three-roll mill at 120° C. for one hour:

| | Parts by Weight |
|---|---|
| Silicone oil "KF96-300CS" (Trademark), made by Shin-Etsu Chemical Co., Ltd. | 200 |
| Polyethylene resin "SANWAX 171P" (Trademark), made by Sanyo Chemical Industries, Ltd. | 30 |
| Strontium titanate (specific gravity: 2.6 g/cm$^3$) | 40 |
| Lecithin | 1 |
| Phthalocyanine blue | 50 |

Thus, a liquid toner M according to the present invention was obtained. The solid content of toner in this liquid toner M was substantially 100 wt. %.

As for the above obtained liquid toners J, K, L and M, the amount of small toner particles with a particle diameter of 0.1 μm or less, the average particle diameter of toner particles, and the melt viscosity of toner particles for use in each liquid toner were measured in the same manner as in Example 1. The results are shown in Table 5.

Then, each liquid toner was appropriately diluted with a proper carrier liquid, and set in a commercially available electrophotographic copying machine "DT-5300" (Trademark), made by Ricoh Company, Ltd., and the same evaluation tests as conducted in Example 1 were carried out. The results are shown in Table 6.

Then, using the liquid toner M obtained in Example 10 with high toner concentration which was not diluted with the carrier liquid, the copying test was carried out. In this case, the above-mentioned photoconductor was modified in such a manner that the selenium photoconductor was replaced by an amorphous silicon photoconductor, and in addition, a silicone oil layer was provided on the surface of the photoconductor. The photoconductor was heated to a temperature in the range of 40 to 120° C. As a result, the image density of the obtained image was 1.38, and the filming phenomenon did not occur until 2,500 copies were made. Even when the silicone-oil-overcoat layer was not provided on the photoconductor, the filming phenomenon was not observed until making of 1,800 copies.

TABLE 5

| | Toner J | Toner K | Toner L | Toner M |
|---|---|---|---|---|
| Amount of small toner particles (wt. %) | 14 | 18 | 16 | 9 |
| Average toner particle dia. (μm) | 0.8 | 0.88 | 0.75 | 0.90 |
| Melt viscosity at 120° C. (mPa · s) | 850 | 900 | 930 | 980 |

TABLE 6

| | Toner J | Toner K | Toner L | Toner M |
|---|---|---|---|---|
| Filming Phenomenon (The number of sheets) | 3000 | 6200 | 5100 | 2500 |
| Image density | 1.19 | 1.38 | 1.31 | 1.38 |
| Gradation | 8 | 8 | 9 | 9 |
| Image blurring | 5 | 5 | 5 | 5 |
| Resolution | 9.5 | 9.8 | 10.0 | 10.2 |

As previously explained, the liquid toners according to the present invention are used for the electrophotographic process, the conventional toner filming problem can be effectively solved.

Japanese Patent Application No. 8-192812 filed Jul. 3, 1996, Japanese Patent Application No. 8-238459 filed Aug. 21, 1996, and Japanese Patent Application filed Jun. 30, 1997 (as yet no application number having been assigned thereto) are hereby incorporated by reference.

What is claimed is:

1. A liquid toner comprising:

a dispersion medium and toner particle, each of which toner particles comprises a coloring agent and a binder agent and is dispersed in said dispersion medium, said toner particles comprising small toner particles with a particle diameter of 0.1 μm or less in an amount of 20 wt. % or less of the total weight of said toner particles, and having an average particle diameter as measured by centrifugal sedimentation of 0.3 to 5 μm and a melt viscosity of 100 to 6,000 mPa·sec at 120° C.

2. The liquid toner as claimed in claim 1, wherein said toner particles have a melt viscosity of 1,000 to 6,000 mPa·sec at 120° C.

3. The liquid toner as claimed in claim 1, wherein said coloring agent comprises a pigment which is coated with a resin that is insoluble in said dispersion medium.

4. The liquid toner as claimed in claim 1, wherein said dispersion medium comprises at least one component selected from the group consisting of silicone oil, fatty acid ester, fluorine-containing oil, isoparaffin, n-paraffin, and wax.

5. A method of producing a liquid toner according to claim 1, comprising the steps of:

kneading or flushing a coloring agent and a binder agent to prepare a kneaded or flushed mixture of said coloring agent and said binder agent, pulverizing said kneaded or flushed mixture to prepare toner particles which comprise small toner particles with a particle diameter of 0.1 μm or less in an amount of 20 wt. % or less of the total weight of said toner particles, and have an average particle diameter as measured by centrifugal sedimentation of 0.3 to 5 μm and a melt viscosity of 100 to 6,000 mPa·sec at 120° C., and dispersing said toner particles in a dispersion medium.

6. The method as claimed in claim 5, further comprising the step of washing said coloring agent with water or a solvent for removing surface treating agents and/or additives from said coloring agent before said kneading or flushing step.

7. A liquid developer comprising:

a liquid toner comprising a dispersion medium and toner particles, each of which toner particles comprises a coloring agent and a binder agent and is dispersed in said dispersion medium, said toner particles comprising small toner particles with a particle diameter of 0.1 μm or less in an amount of 20 wt. % or less of the total weight of said toner particles, and having an average particle diameter of 0.3 to 5 μm as measured by centrifugal sedimentation of 0.3 to 5 μm and a melt viscosity of 100 to 6,000 mPa ·sec at 120° C., and an additional carrier liquid in which said liquid toner is dispersed.

8. The liquid developer as claimed in claim 7, wherein said toner particles have a melt viscosity of 1,000 to 6,000 mPa·sec at 120° C.

9. The liquid developer as claimed in claim 7, wherein said coloring agent comprises a pigment which is coated with a resin that is insoluble in said dispersion medium.

10. The liquid developer as claimed in claim 7, wherein said dispersion medium comprises at least one component selected from the group consisting of silicone oil, fatty acid ester, fluorine-containing oil, isoparaffin, n-paraffin, and wax.

11. A method of producing a liquid developer according to claim 7, comprising the steps of:

kneading or flushing a coloring agent and a binder agent to prepare a kneaded or flushed mixture of said coloring agent and said binder agent, pulverizing said kneaded or flushed mixture to prepare toner particles which comprise small toner particles with a particle diameter of 0.1 μm or less in an amount of 20 wt. % or less of the total weight of said toner particles, and have an average particle diameter as measured by centrifugal sedimentation of 0.3 to 5 μm and a melt viscosity of 100 to 6,000 mPa·sec at 120° C., dispersing said toner particles in a dispersion medium to prepare a liquid toner, and diluting said liquid toner with an additional carrier liquid.

12. The method as claimed in claim 11, further comprising the step of washing said coloring agent with water or a solvent for removing surface treating agents and/or additives from said coloring agent before said kneading or flushing step.

13. An image formation method comprising the step of developing a latent electrostatic image formed on a photoconductor to a toner image, using a liquid toner comprising (a) toner particles, each of which toner particles comprises a coloring agent and a binder agent, said toner particles comprising small toner particles with a particle diameter of 0.1 μm or less in an amount of 20 wt. % or less of the total weight of said toner particles, and having an average particle diameter as measured by centrifugal sedimentation, and a melt viscosity of 100 to 6,000 mPa·sec at 120° C., and (b) a dispersion medium in which said toner particles are dispersed, the amount of said toner particles being in the range of 5 to 100 wt. % of the total weight of said liquid toner.

14. The image formation method as claimed in claim 13, wherein said toner particles have a melt viscosity of 1,000 to 6,000 mPa·sec at 120° C.

15. The image formation method as claimed in claim 13, wherein said coloring agent comprises a pigment which is coated with a resin that is insoluble in said dispersion medium.

16. The image formation method as claimed in claim 13, wherein said dispersion medium comprises at least one component selected from the group consisting of silicone oil, fatty acid ester, fluorine-containing oil, isoparaffin, n-paraffin, and wax.

17. The image formation method as claimed in claim 13, further comprising the steps of:

transferring said toner image to an intermediate image-transfer medium, and transferring said toner image from said intermediate image-transfer medium to a transfer sheet.

* * * * *